US005870831A

United States Patent [19]

Wagner

[11] Patent Number: 5,870,831

[45] Date of Patent: Feb. 16, 1999

[54] CERAMIC AND MARBLE WALL-CUT MEASURING RULER

[76] Inventor: Karl R. Wagner, 1488 Owen Dr., Clearwater, Fla. 34619

[21] Appl. No.: 743,041

[22] Filed: Nov. 4, 1996

[51] Int. Cl.[6] ..... B43L 7/00

[52] U.S. Cl. ..... 33/494; 33/526

[58] Field of Search ..... 33/494, 526, 527

[56] References Cited

U.S. PATENT DOCUMENTS

| | | | |
|---|---|---|---|
| 2,144,697 | 1/1939 | Zangrando | 33/527 |
| 2,904,891 | 9/1959 | Cook | 33/494 |
| 4,301,596 | 11/1981 | Sedlock | 33/494 |
| 5,056,234 | 10/1991 | Han | 33/494 |
| 5,181,326 | 1/1993 | Eberline | 33/527 |

*Primary Examiner*—Diego F. F. Gutierrez
*Assistant Examiner*—Andrew Hirchfeld

[57] ABSTRACT

The ceramic tile and marble wall-cut measuring ruler enables the tile or marble installer to properly measure the pieces of tile or marble which will be cut and installed between the wall and the previously installed tile or marble on the floor or wall. This device is a one piece ruler-like measuring device which will automatically deduct the size of the required grout-line measurement from the tile or marble to be cut, there-by saving installation time and product waste. The ceramic tile and marble wall-cut measuring ruler will be manufactured for specific size grout lines, of which the normal standards for grout lines are ¼,½, and ¾ inches in measurement.

1 Claim, 1 Drawing Sheet

CERAMIC AND MARBLE WALL-CUT MEASURING RULER

BACKGROUND OF THE INVENTION

FIELD OF THE INVENTION

The ceramic and marble wall-cut measuring ruler was designed by me for use in the tile and marble flooring and wall industry. It is a measuring device for use by the tile and marble installers to quickly and accurately measure a section or piece of tile or marble to be cut and properly installed with the correct grout line measurement automatically deducted from the measuring ruler.

SUMMARY OF THE INVENTION

The ceramic tile and wall-cut measuring ruler allows the tile installer to accurately and efficently measure the exact size of the tile to be cut, with the precise grout line measurement automatically calculated and deducted for him. The advantages of using the ceramic tile and marble wall-cut measuring ruler over the standard and normal procedures for measuring wall and grout line cutsare as follows:

1. Automatically eliminates mathematical errors caused by in-accurate measurements.
2. Saves time in measuring calculations
3. Eliminates product waste due to in-accurate measurements
4. Increases installation productivity

DETAILED DESCRIPTION OF THE INVENTION

Figure 1:
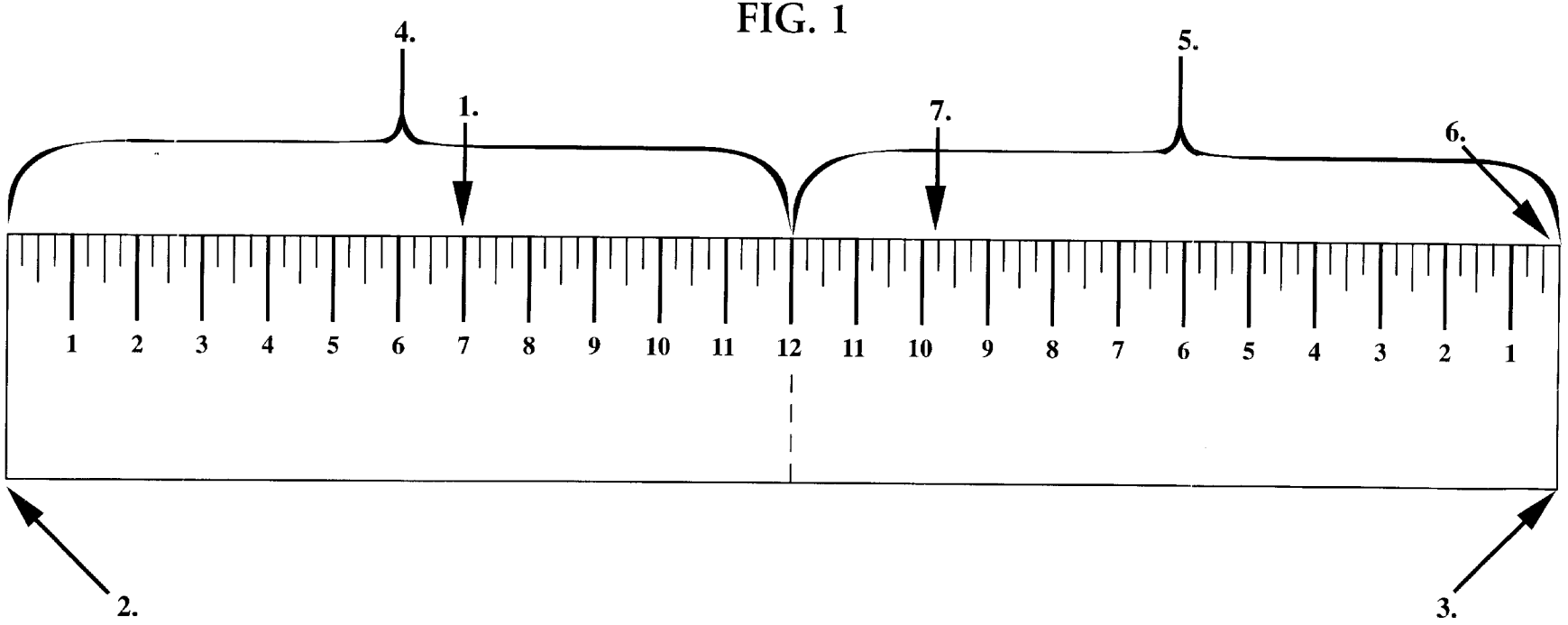
FIG. 1 is a scaled-down view of the invention.

Referring specifically to the drawing (FIG. 1), the numeral 1 designates the elongated face view of the ceramic tile and marble wall-cut measuring ruler. It may be seen that the measuring ruler includes a first and second end, #2 and #3, and a first and second section, #4 and #5, with the distance between #2 and #3 designated by a longitudinal marginal edge, #7, indicated by a scale(in inches and fractions thereof). Numeral 6 refers to the end of the second section, #5, which has a fractional measurement deducted from the ceramic tile and marble wall-cut measuring ruler, such deducted measurement to determine the exact size of the required grout line measurement.

Material and Size

The ceramic tile and marble wall-cut measuring ruler will be constructed of either wood, metal, or plastic, and will have a total length determined by the correct size grout line required. The width of the ceramic tile and marble wall-cut measuring ruler will be of such size as to place the necessary measuring marks on the face of the ruler. The depth of the ruler will be a minimum of 1/16 inch to as much as 3/8 inch thick.

Directions For the Use of the Ceramic Tile and Marble Wall-Cut Measuring Ruler 1. Place the left side (2) of the ruler flush against the wall with the right end (3) of the ruler overlapping the previously installed tile or marble.

2. Read the measurement between the wall and the closest point of the previously installed tile or marble, using the scale on the first section #4.

3. Place the measuring ruler over the tile or marble to be measured and cut, with the right end, #3, flush against the end of the tile or marble.

4. Mark the tile or marble to be measured and cut using the scale on the second section, #5, and the same measurement figure which was determined in step #2. This measurement will already have the precise grout line deduction calculated.

5. Cut the tile or marble.

6. Install the tile or marble cut

I claim:

1. A measuring ruler for measuring and marking a tile to be cut precisely, said tile to be cut intended to be placed between a last placed tile and a tile end line which are spaced apart less than a width of the tile being cut and and placed adjacent to the last placed tile, said ruler comprising;

an elongated body having a first end and a second end, said body including a first section starting at said first end and extending to a second section which extends to said second end;

said first section including a first scale starting from zero at the first end of the body and increasing to a maximum width;

said second section including a second scale starting from the maximum width and decreasing to a measurement of a desired grout line between the tiles at said second end;

wherein the first scale is used to measure the opening between the last placed tile and the tile end line and the second scale is used to directly measure and mark the tile to be cut so that the tile to be cut will fit precisely between the last placed tile and tile end line with the desired grout line measurement.

* * * * *